US009170055B2

(12) United States Patent
Jekerle et al.

(10) Patent No.: US 9,170,055 B2
(45) Date of Patent: Oct. 27, 2015

(54) TUBE BUNDLE HEAT EXCHANGER FOR CONTROLLING A WIDE PERFORMANCE RANGE

(75) Inventors: Jiri Jekerle, Kassel (DE); Klaus-Dieter Rothenpieler, Kassel (DE)

(73) Assignee: ARVOS TECHNOLOGY LIMITED, Brugg (CH)

( * ) Notice: Subject to any disclaimer, the term of this patent is extended or adjusted under 35 U.S.C. 154(b) by 1087 days.

(21) Appl. No.: 12/998,034

(22) PCT Filed: Sep. 18, 2009

(86) PCT No.: PCT/DE2009/001317

§ 371 (c)(1), (2), (4) Date: Apr. 11, 2011

(87) PCT Pub. No.: WO2010/034292

PCT Pub. Date: Apr. 1, 2010

(65) Prior Publication Data

US 2011/0186275 A1 Aug. 4, 2011

(30) Foreign Application Priority Data

Sep. 23, 2008 (DE) ..... 10 2008 048 405

(51) Int. Cl.
*B60H 1/00* (2006.01)
*F28F 27/02* (2006.01)
(Continued)

(52) U.S. Cl.
CPC . *F28D 7/16* (2013.01); *F28F 27/02* (2013.01); *F28F 2250/102* (2013.01)

(58) Field of Classification Search
CPC ..... F28F 2250/06; F28F 2250/102; F28F 2250/106; F28F 2250/108; F28F 2250/10; F28F 13/06; F28F 2250/00; F28D 7/16; F28D 7/1623; Y10T 137/6416; Y10T 137/6579; Y10T 137/86493; Y10T 137/86549
USPC ..... 165/11.1, 97, 103, 95, 158; 137/340, 137/334, 625, 625.17, 599.14
See application file for complete search history.

(56) References Cited

U.S. PATENT DOCUMENTS 4,102,393 A * 7/1978 Withers, Jr. ..... 165/95
4,220,011 A * 9/1980 Bergman et al. ..... 62/185
(Continued)

FOREIGN PATENT DOCUMENTS

DE 1776089 9/1968
DE 29 12 321 10/1979
(Continued)

OTHER PUBLICATIONS

International Search Report dated Sep. 28, 2010, corresponding to German Application PCT/DE2009/001317.
(Continued)

*Primary Examiner* — Allen Flanigan
*Assistant Examiner* — Jason Thompson
(74) *Attorney, Agent, or Firm* — MKG, LLC

(57) ABSTRACT

A tube bundle heat exchanger includes tubes channeling a gas flow and a pressure shell enclosing the tubes channeling a coolant flow. First and second nozzles are disposed at a rear end of the pressure shell and third and fourth nozzles are disposed at a front end of the pressure shell. A feed pipe includes a first three-way valve and a drain pipe includes a second three-way valve. A first bypass pipe is connected to the first three-way valve and the third nozzle, a second bypass pipe is connected to the first three-way valve and the first nozzle, a third bypass pipe is connected to the second three-way valve and the second nozzle, and a fourth bypass pipe is connected to the second three-way valve and the fourth nozzle. One of the three-way valves is controllable.

20 Claims, 6 Drawing Sheets

(51) Int. Cl.
*F28F 9/02* (2006.01)
*F28D 7/16* (2006.01)

(56) References Cited

U.S. PATENT DOCUMENTS

| | | | | |
|---|---|---|---|---|
| 4,346,758 | A * | 8/1982 | Kehrer et al. | 165/134.1 |
| 4,577,677 | A * | 3/1986 | Ezzell | 165/95 |
| 5,615,738 | A * | 4/1997 | Cameron et al. | 165/103 |
| 2006/0090880 | A1* | 5/2006 | Sugihara et al. | 165/103 |
| 2006/0169305 | A1* | 8/2006 | Jansen et al. | 134/22.18 |
| 2007/0257122 | A1* | 11/2007 | Shimada et al. | 237/12 |

FOREIGN PATENT DOCUMENTS

| | | | |
|---|---|---|---|
| DE | 29 13 748 | | 10/1980 |
| GB | 2 018 967 | A | 10/1979 |
| GB | 2047866 | A * | 12/1980 |
| JP | 189478 | | 12/1983 |

OTHER PUBLICATIONS

German Search Report, dated Sep. 21, 2009.

* cited by examiner

TUBE BUNDLE HEAT EXCHANGER FOR CONTROLLING A WIDE PERFORMANCE RANGE

CROSS-REFERENCE TO RELATED APPLICATIONS

This is the national stage of International Application No. PCT/DE2009/001317 filed Sep. 18, 2009.

BACKGROUND

The invention relates to a tube bundle heat exchanger for controlling a wide performance range.

For the purpose of cooling medium flows, in particular of gases, in numerous process technology plants such as gasification plants, thermal and catalytic cracking plants, steam reforming plants etc., as a rule heat exchangers, in particular tube bundle heat exchangers (radiators), are used, in which the medium flows to be cooled flow through straight heating surface tubes and in this process transfer the existing heat of the hot medium flow by way of the tube wall to the cooling medium that surrounds the tubes.

It is the main task of such a heat exchanger or tube bundle heat exchanger, as stated above, to transfer heat between two media, wherein a particular quantity of heat is removed from the one medium (hot medium), and an adequate quantity of heat is fed to the other medium (cooling medium). It is well known that the quantity of the heat transferred depends on the size of the heat exchanger, on the heat transfer coefficients of the two media, and on the temperature difference between the two media. In single-phase media the medium temperature changes with the infeed of heat or with the removal of heat. In this case the temperature gradient over the device length of the heat exchanger resembles an exponential function.

As a rule, a tube bundle heat exchanger comprises a large number of heating surface tubes, a pressure shell that surrounds the heating surface tubes and that forms a shell side, and two tubesheets, between which the heating surface tubes are arranged. The first medium flows through the tube inlet chamber of the heat exchanger, then through the heating surface tubes and through the tube outlet chamber of the heat exchanger. The second medium flows by way of a nozzle into the shell side of the heat exchanger, flows several times around the individual heating surface tubes, and subsequently flows through a second nozzle out of the heat exchanger.

The two media can flow in a heat exchanger or tube bundle heat exchanger in the same axial direction of the heat exchanger (co-current flow), or one of the two media can flow within the heat exchanger in the opposite direction relative to the other medium (counter current flow). The temperature gradient of the heat exchange of the media with counter current flow differs from that with co-current flow and thus results in a difference in the average logarithmic temperature difference between the two media. The quantity of heat transferred between the two media is thus different in both circuit connections, i.e. counter current flow connection or co-current flow connection.

The output of the heat exchanger or of the tube bundle heat exchanger can change as a result of fouling (build-up of deposits or dirt within the heating surface tubes) or as a result of other influences over the service life of the tube bundle heat exchanger; a situation which results in the need for control intervention. At the same time there is often the need to adjust the quantity of heat to be transferred or the exit temperatures of the medium to the desired operating load. Frequently, bypass control comprising a bypass pipe and a three-way mixing valve, i.e. a regulated three-way valve, is used for controlling the exit temperatures of the medium and thus the thermal output of the tube bundle heat exchanger. In this process, part of the medium flow is removed from the main flow before it is fed to the tube bundle heat exchanger, and is made to bypass the tube bundle heat exchanger. The reduced flow quantity of a medium reduces heat transfer and, by way of the changed exit temperature of the medium, influences the average logarithmic temperature difference. The control range or the control intervention that is achievable with this bypass arrangement is, however, relatively modest.

It is the object of the present invention to create a tube bundle heat exchanger with a bypass system in which the above-mentioned disadvantages are avoided, or in which the exit temperatures of the media and the quantity of heat to be transferred are controllable in a very wide range.

SUMMARY

The solution according to the invention creates a tube bundle heat exchanger that comprises the following advantages:

A tube bundle heat exchanger with a wide control range is provided, and thus improved control of the tube bundle heat exchanger on the cold end of a waste heat section is made possible.

In an advantageous embodiment, in relation to the cooling medium flow, the controllable three-way valve is arranged in the drain side of the tube bundle heat exchanger. This arrangement provides an advantage in that the exit temperature of the medium is precisely controllable. In a further advantageous embodiment, apart from the one controlled three-way valve the further three-way valve is designed as a switch valve. With the switch valve that is designed as a three-way valve the complete cooling medium flow can be channeled in a clearly defined manner into the front or back end of the shell side, or led from the front or back end of the shell side, and thus a co-current flow or counter current flow of the cooling medium relative to the first medium flow in the shell side can be achieved.

Expediently, the three-way valve that is designed as a switch valve is to be arranged in relation to the cooling medium flow in the feed side of the tube bundle heat exchanger.

In an advantageous embodiment of the invention, apart from the one controlled three-way valve, the further three-way valve is also a controlled three-way valve. In this case it becomes possible to control which of the two three-way valves operates as a switch valve.

In a particularly advantageous manner a flow rate measurement device is arranged within the bypass pipe. By means of this flow rate measurement device or these flow rate measurement devices the partial mass flows within the bypass pipe can be acquired with high precision and can thus as controlled quantities have an influence on the control process and on the controlled three-way valve.

In an expedient manner, the nozzles at the back end of the pressure shell and/or the nozzles at the front end of the pressure shell are in each case situated identically when viewed in the direction of the longitudinal axis L of the tube bundle heat exchanger. This results in a short distance when flowing through the shell side in the case of a bypass of a partial mass flow of the cooling medium.

Furthermore, an advantageous embodiment of the invention provides for the nozzles on the back end of the pressure shell and/or the nozzles on the front end of the pressure shell in relation to a plane E that is arranged so as to be perpendicular to the longitudinal axis L of the tube bundle heat exchanger to rest on said plane at any desired angle relative to each other. In this way the resistance or the pressure loss of the partial flow of the cooling medium flow to be bypassed can be reduced or can be kept low.

Below, exemplary embodiments of the invention are explained in more detail with reference to the drawing and the description.

BRIEF DESCRIPTION OF THE DRAWINGS

The following are shown.

DETAILED DESCRIPTION

Figure 1:
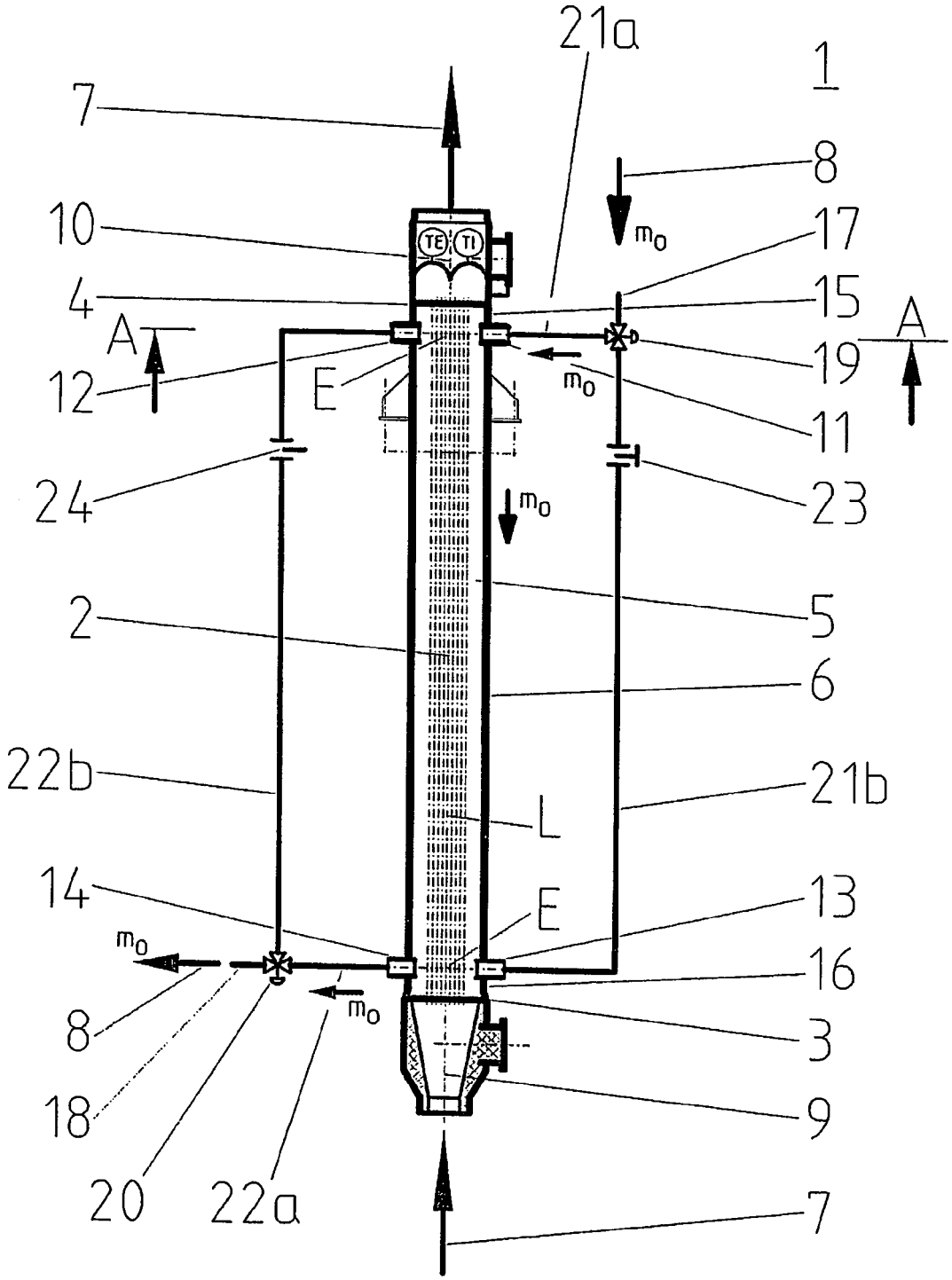
FIG. 1 a diagrammatic longitudinal section of a tube bundle heat exchanger in which the cooling medium is channeled through the heat exchanger in counter current flow.

FIG. 1 shows a diagrammatic longitudinal section of a tube bundle heat exchanger 1. Such tube bundle heat exchangers 1 are required in numerous process technology plants, for example in gasification plants, thermal and catalytic cracking plants, steam reforming plants etc., in which a process gas, a waste gas or the like is produced. As a rule, the tube bundle heat exchanger 1 is used to cool the above-mentioned hot gas or a first medium flow 7, which is introduced through a pipe (not shown) into the tube inlet chamber 9 of the tube bundle heat exchanger 1, and from there is channeled through a multitude of straight heating surface tubes 2, subsequently is collected in the tube outlet chamber 10 of the tube bundle heat exchanger 1, and by means of a pipe (not shown) is led out of the tube bundle heat exchanger 1. In this arrangement the heating surface tubes 2, through which indirect heat exchange with a cooling medium 8 that surrounds the heating surface tubes 2 takes place, are in each instance arranged, so as to spaced apart from each other, between two tubesheets 3, 4 and are in a firm and gas-proof manner connected, as a rule welded, to said tubesheets 3, 4.

The entire heating surface tubes 2 are enclosed by a pressure shell 6 that forms a shell side 5. At the two ends of the pressure shell 6 there are two connecting stubs for channeling the cooling medium flow 8 into or out of the shell side 5. For the sake of improved allocation, in the present document the end of the pressure shell 6, which end adjoins the tube outlet chamber 10 is referred to as the back end 15, while the end of the pressure shell 6, which end adjoins the tube inlet chamber 9, is referred to as the front end 16. According to the invention, two nozzles 11, 12 are arranged at the back end 15 and two nozzles 13, 14 are arranged at the front end 16, wherein the respective first nozzle 11, 13 at the back and at the front ends 15, 16 is used for leading the cooling medium flow 8 into the shell side 5, while the respective second nozzle 12, 14 at the back and at the front ends 15, 16 is used for leading away the cooling medium flow 8 from the shell side 5. According to the invention, the two nozzles 11, 13 for feeding the cooling medium flow 8 are in each instance connected to a first and a second bypass pipe 21*a*, 21*b*, wherein both bypass pipes 21*a*, 21*b* lead to a first three-way valve 19 and are in each instance connected to said three-way valve 19. As the third pipe, the feed pipe 17 is connected to the three-way valve 19, through which the cooling medium flow m0 8 is fed to the tube bundle heat exchanger 1.

According to the invention, on the drain side of the tube bundle heat exchanger 1 the two nozzles 12, 14 for leading away the cooling medium flow 8 are in each instance connected to a third and fourth bypass pipe 22*a*, 22*b*, wherein both bypass pipes 22*a*, 22*b* lead to a second three-way valve 20 and are in each instance connected to said second three-way valve 20. As the third pipe, the drain pipe 18 is connected to the three-way valve 20, through which the cooling medium flow m0 8 is lead out from the tube bundle heat exchanger 1. According to the invention, one of the two three-way valves 19, 20 is designed so as to be controllable.

Figure 2:
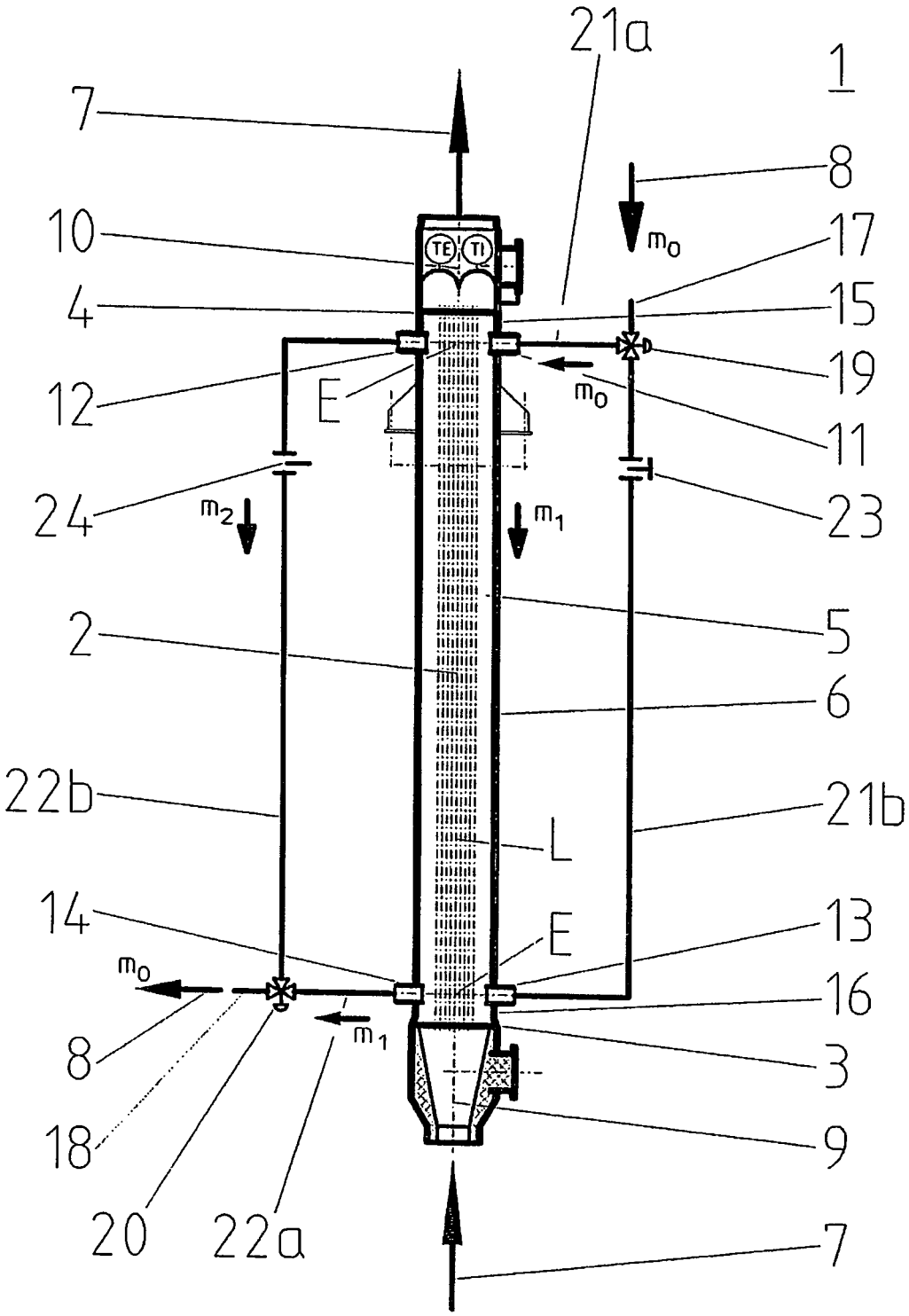
FIG. 2 as in FIG. 1, wherein however a partial flow of the cooling medium flow is channeled through the second bypass pipe.

FIGS. 1 and 2 show circuit connections of the tube bundle heat exchanger 1 according to the invention, in which the cooling medium flow 8 flows through the heat exchanger in counter current flow to the first medium flow 7. In this arrangement, FIGS. 1 and 2 show preferred variants which in the second three-way valve 20 in the drain pipe 18 provide a controlled three-way valve and in the first three-way valve 19 in the feed pipe 17 provide a three-way valve that is designed as a switch valve. According to FIG. 1, the three-way valve 19, which is designed as a switch valve, is controlled in such a way that the feed pipe of the cooling medium flow 8 is channeled through the feed pipe 17 and through the first bypass pipe 21*a* to the back end 15 of the shell side 5, and the three-way valve 20 is controlled such that the complete infed mass flow m0 of the cooling medium flow 8 is channeled through the shell side 5 and is lead away through the third bypass pipe 22*a* and the drain pipe 18. As far as the three-way valve 19, which is designed as a switch valve, is concerned, FIG. 2 shows no change when compared to the circuit connection shown in FIG. 1, i.e. feeding the cooling medium flow 8 takes place into the back end 15 of the shell side 5, wherein, however, now the three-way valve 20 is regulated in such a way that a partial flow m2 of the complete infed mass flow m0 of the cooling medium flow 8 is channeled through the fourth bypass pipe 22*b*, and the remaining partial flow m1 is channeled through the shell side 5 and through the third bypass pipe 22*a*, and both partial flows m1 and m2 together are led away through the drain pipe 18. The three-way valve 19, which is designed as a switch valve, is a controlled directing member that channels the infed cooling medium flow 8 to one of the two existing exits, namely the bypass pipes 21*a* and 21*b*.

Figure 3:
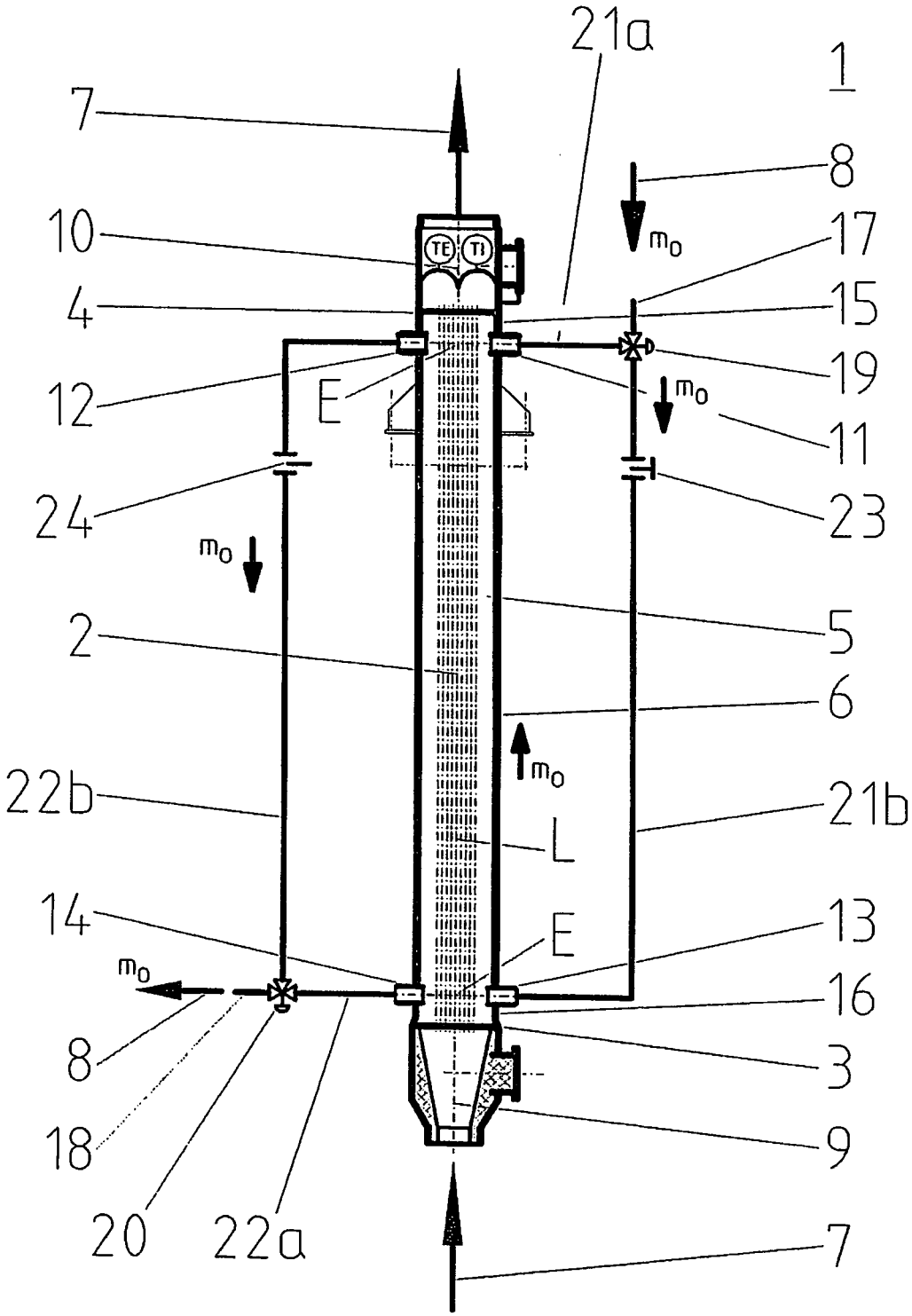
FIG. 3 a diagrammatic longitudinal section of a tube bundle heat exchanger in which the cooling medium is channeled through the heat exchanger in co-current flow.
Figure 4:
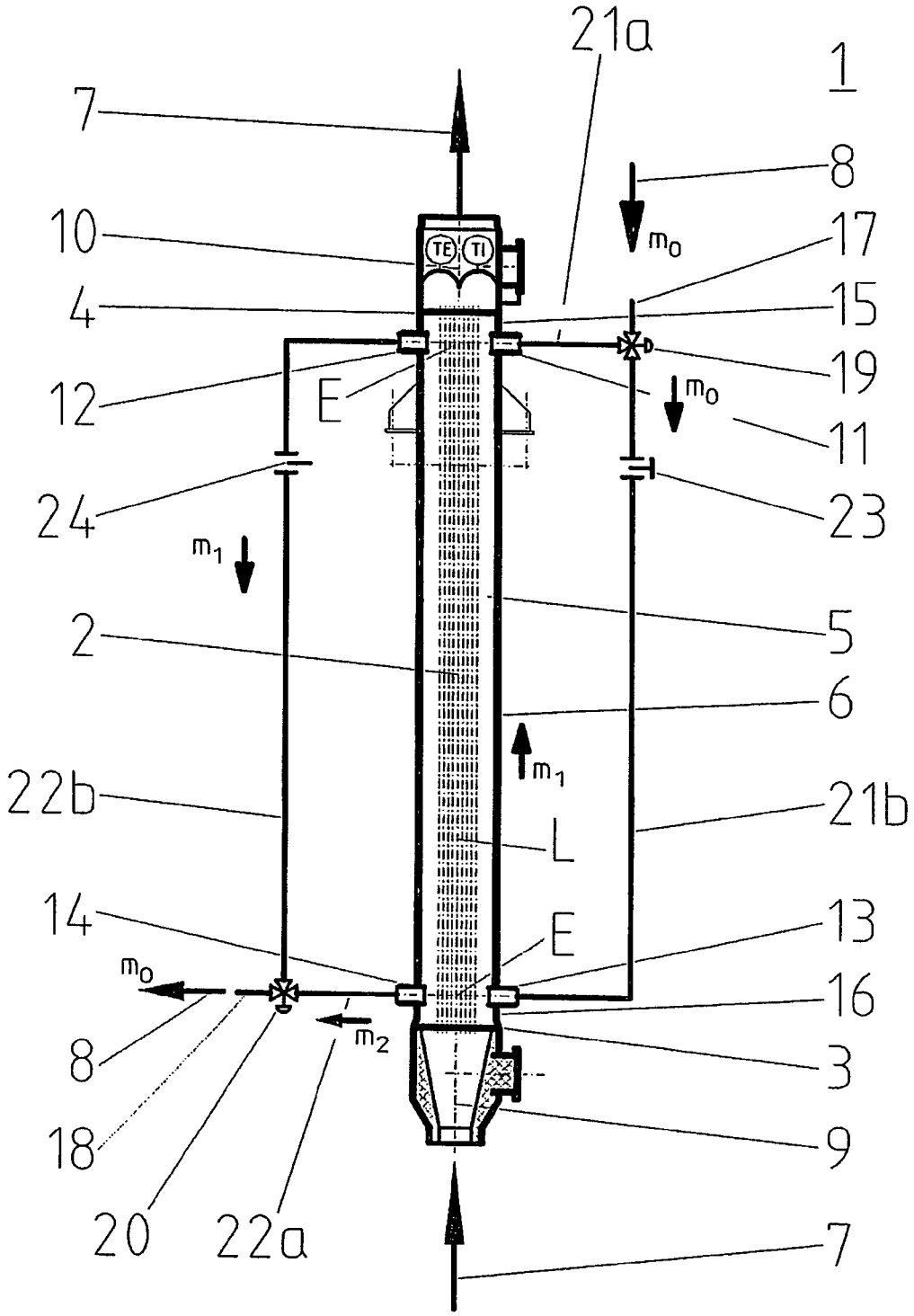
FIG. 4 as in FIG. 3, wherein however prior to being channeled through the shell side of the tube bundle heat exchanger a partial flow of the cooling medium flow is diverted and channeled to the drain pipe.

FIGS. 3 and 4 show circuit connections of the tube bundle heat exchanger 1 according to the invention, wherein the cooling medium flow 8 flows through the tube bundle heat exchanger 1 in co-current flow with the first medium flow 7, i.e. the two medium flows 7, 8 flow in the same direction within the tube bundle heat exchanger 1. As was the case previously in FIGS. 1 and 2, FIGS. 3 and 4 show preferred variants which in the second three-way valve 20 in the drain pipe 18 provide for a controlled three-way valve and in the case of the first three-way valve 19 in the feed pipe 17 provide for a three-way valve that is designed as a switch valve. In a manner that differs from FIG. 1, the three-way valve 19 according to FIG. 3, which is designed as a switch valve, is controlled in such a way that the feed of the cooling medium flow 8 through the second bypass pipe 21*b* is channeled into the front end 16 of the shell side 5, and the three-way valve 20 is controlled in such a way that the complete infed mass flow m0 of the cooling medium flow 8 is channeled through the shell side 5 and subsequently is lead away through the fourth bypass pipe 22*b* and through the drain pipe 18 downstream of the three-way valve 20. As far as the three-way valve 19, which is designed as a switch valve, is concerned, FIG. 4 shows no change when compared to the circuit connection of FIG. 3, i.e. feeding the cooling medium flow 8 takes place into the front end 16 of the shell side 5, wherein, however, now the three-way valve 20 is controlled in such a way that a partial flow m2 of the complete infed mass flow m0 of the cooling medium flow 8 is channeled through the third bypass pipe 22*a* between the nozzle 14 and the three-way valve 20; and the remaining partial flow m1 is channeled through the shell side 5 and through the fourth bypass pipe 22*b*, and both partial flows m1 and m2 together are led away through the drain pipe 18.

By means of the circuit connections shown in FIGS. 1 to 4 it is possible to operate a tube bundle heat exchanger 1 in a very wide control range because the quantity of heat to be transmitted, or the exit temperatures of the medium, can on the one hand, by changing the direction of flow of one of the two media, be changed from co-current flow to counter current flow or vice versa, and can, on the other hand, by means of the controlled three-way valve the cooling media flows be divided in a controlled manner to the shell side 5 and the bypass pipe(s) 21*a*, 21*b*, 22*a*, 22*b*, and in this way the quantity of heat or the exit temperatures of the medium can be controlled in a very differentiated manner.

Figure 5:
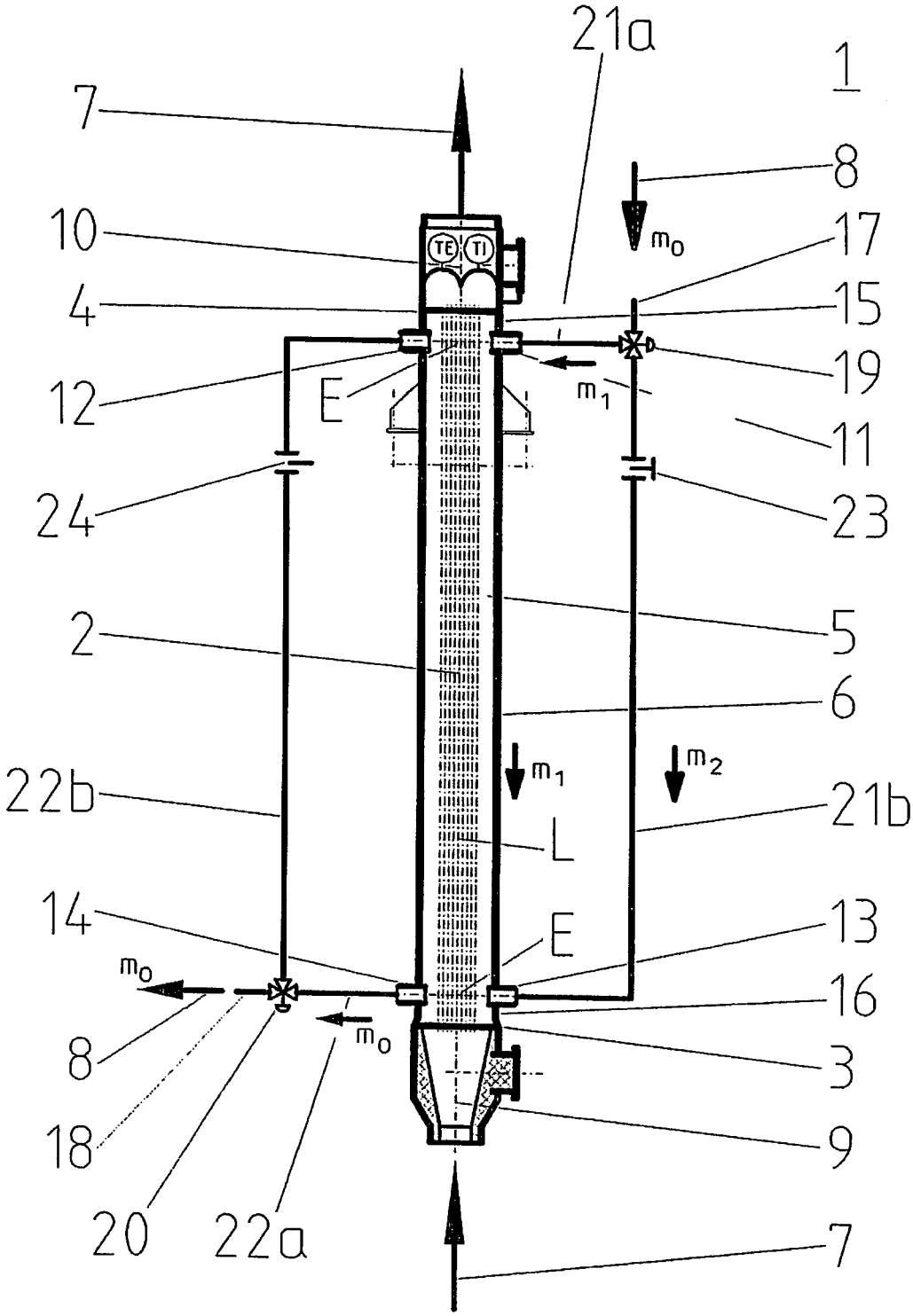
FIG. 5 an alternative embodiment to that of FIG. 2.

Apart from the preferred connecting variants shown in FIGS. 1 to 4, the first three-way valve 19, i.e. the three-way valve located in the feed pipe 17, can be designed as a controlled three-way valve, and the second three-way valve 20, i.e. the three-way valve located in the drain pipe 18, can be designed as a switch valve. FIG. 5 shows this variant in which the three-way valve 19 controls the mass flow m0 of the cooling medium flow 8, which mass flow m0 flows in the feed pipe 17, in that said three-way valve 19 feeds a partial mass flow m1 through the first bypass pipe 21*a* to the shell side 5, and feeds a partial mass flow m2 through the second bypass pipe 21*b* and thus past the shell side 5 of the tube bundle heat exchanger 1 and into the front end 16 of the shell side 5. With a corresponding position of the three-way valve 20 that is designed as a switch valve, the complete mass flow m0 exits from the tube bundle heat exchanger 1 through the third bypass pipe 22*a* and the drain pipe 18. In the circuit connection according to FIG. 5 it is advantageous if the controlled three-way valve 19 is arranged in the infeed region, and thus in the cold region, of the cooling medium flow 8. This can provide an advantage when compared to arrangements in which cooling medium flows 8 at the drain exit at very hot temperatures, because in this way the contact of the controlled three-way valve 19 with the very hot cooling medium flow 8 is avoided. In contrast to the arrangements according to FIGS. 1 to 4, in the present arrangement the three-way valve 20, which is designed as a switch valve, takes up the led-out cooling medium flow 8 in one of the two existing entries, namely one of the bypass pipes 22*a* and 22*b*.

Instead of a three-way valve that is designed as a switch valve, a further controlled three-way valve can be used, which would mean that both three-way valves 19, 20 are designed so as to be controlled. In such a case it is, however, sensible if one of the two controlled three-way valves 19, 20, assumes the function of a pure switch valve.

According to FIGS. 1 to 5, the nozzles 11, 12 at the back end 15 of the pressure shell 6 and the nozzles 13, 14 at the front end 16 of the pressure shell 6 are situated identically when viewed in the direction of the longitudinal axis L of the tube bundle heat exchanger 1. It is also possible to arrange the respective nozzles 11, 12 at the back end 15 and/or the respective nozzles 13, 14 at the front end 16 in the direction of the longitudinal axis L of the tube bundle heat exchanger 1.

Figure 6:
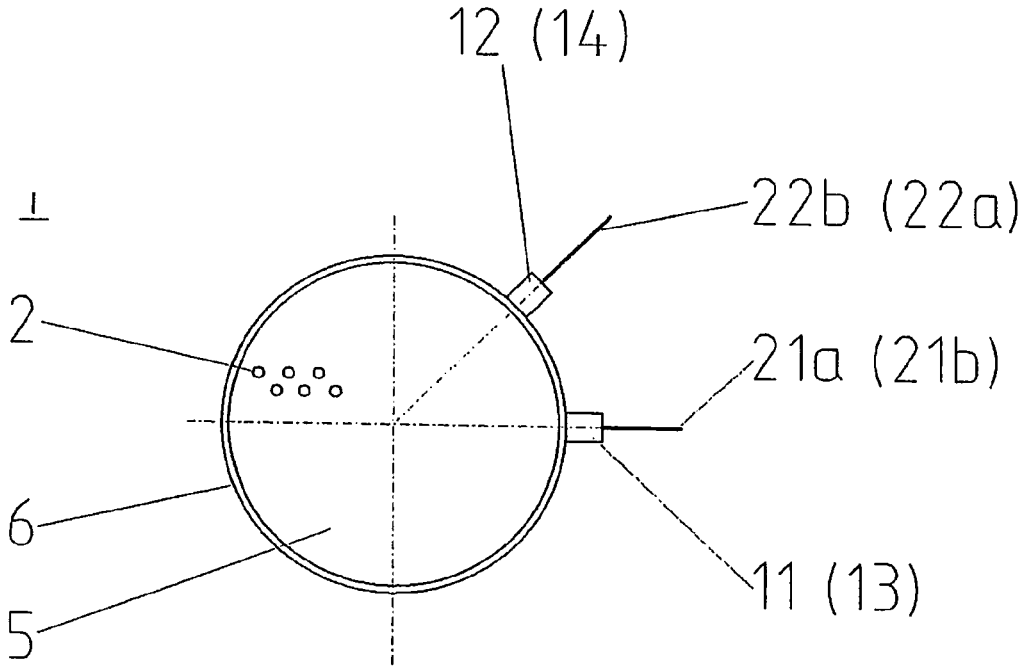
FIG. 6 a diagrammatic cross section, on the plane of the nozzle, which cross section corresponds to section A-A in FIG. 1, of the tube bundle heat exchanger.

While in FIGS. 1 to 5 the nozzles 11, 12 at the back end 15, and the nozzles 13, 14 at the front end 16 at least in the diagrammatic view are in each case arranged opposite each other, i.e. are positioned on the circumference of the pressure shell at 180° to each other, FIG. 6 shows a further option in which the nozzles 11, 12 as an example are positioned on a plane E that is perpendicular to the longitudinal axis L of the tube bundle heat exchanger 1 at 45° to each other. This angle between the two nozzles can be designed in any desired way and depends among other things on the narrowness of the passages between the heating surface tubes 2 within the shell side 5. If the passages are very narrow, it is likely that a smaller angle between the two nozzles 11, 12 is selected in order to make possible a relatively resistance-free flow and exit of a partial mass flow of the cooling medium flow 8, which partial mass flow is intended for the bypass pipe 22. The above considerations also apply to the nozzles 13, 14 at the front end 16 of the pressure shell 6.

In order to be able to effect control of the mass flows m0 or m1 and m2 of the cooling medium flow 8 that are to be channeled through the shell side 5 and if applicable through the bypass pipes 21*a*, 21*b*, 22*a*, 22*b* by way of the three-way valve 19, 20, among others according to FIGS. 1 to 5, by way of examples, flow rate measurement devices 23, 24 are arranged in the bypass pipes 21*b*, 22*b*. The total mass flow m0 of the cooling medium flow 8, which total mass flow m0 is fed-in in the feed pipe 17, is known on the plant side and can, or must, correspondingly be used for any division, on the control side, into the two partial mass flows m1 and m2.

The invention claimed is:

1. A tube bundle heat exchanger for cooling a first medium flow with a cooling medium flow, the heat exchanger comprising:

a plurality of heating surface tubes adapted to receive and channel the first medium flow, each of the heating surface tubes having oppositely disposed end portions held in a tubesheet;

a pressure shell enclosing the heating surface tubes, the pressure shell defining a shell side adapted to receive and channel the cooling medium flow;

at least one tube inlet chamber adapted to direct the first medium flow into the heating surface tubes, and at least one tube outlet chamber adapted to collect the first medium flow from the heating surface tubes;

first and second nozzles disposed at a rear end of the pressure shell adjoining the tube outlet chamber, the first nozzle being adapted to lead in the cooling medium flow and the second nozzle being adapted to lead away the cooling medium flow;

third and fourth nozzles disposed at a front end of the pressure shell adjoining the tube inlet chamber, the third nozzle being adapted to lead in the cooling medium flow and the fourth nozzle being adapted to lead away the cooling medium flow;

a first three-way valve defining a first port, a second port and a third port, a feed pipe connected to the first port and configured to supply the cooling medium flow to the first port, a first bypass pipe extending between the third nozzle and the second port, and a second bypass pipe extending between the first nozzle and the third port;

a second three-way valve defining a fourth port, a fifth port and a sixth port, a drain pipe connected to the sixth port and configured to discharge the cooling medium flow from the sixth port, a third bypass pipe extending between the fourth nozzle and the fourth port, and a fourth bypass pipe extending between the second nozzle and the fifth port;

the first three-way valve and the second three-way valve being controllable to selectively change the heat exchanger from counter-current flow to co-current flow and from co-current flow to counter-current flow, and the first three-way valve being controllable to selectively regulate flow of the cooling medium through the first bypass pipe and the second bypass pipe, and the second three-way valve being controllable to selectively regulate flow of the cooling medium through the third bypass pipe and the fourth bypass pipe; and wherein the second three-way valve is configured to control a temperature of the cooling medium discharged through the sixth port.

2. The tube bundle heat exchanger according to claim 1, wherein one or more of the first and second three-way valves is a switch valve.

3. The tube bundle heat exchanger according to claim 2, wherein in relation to the cooling medium flow the one or more of the first and second three-way valves having a switch valve is disposed at a feed side of the tube bundle heat exchanger.

4. The tube bundle heat exchanger according to claim 1, comprising:

a flow rate measurement device disposed within one or more of the first, second, third, or fourth bypass pipes.

5. The tube bundle heat exchanger according to claim 1, wherein the nozzles at the rear end of the pressure shell, and the nozzles at the front end of the pressure shell are situated identically when viewed in the direction of a longitudinal axis of the tube bundle heat exchanger.

6. The tube bundle heat exchanger according to claim 1, wherein the nozzles at the rear end of the pressure shell, or the nozzles at the front end of the pressure shell are situated identically when viewed in the direction of a longitudinal axis of the tube bundle heat exchanger.

7. The tube bundle heat exchanger according to claim 1, wherein the nozzles on the rear end of the pressure shell, and the nozzles on the front end of the pressure shell in relation to a plane that is arranged so as to be perpendicular to a longitudinal axis of the tube bundle heat exchanger rest on said plane at any desired angle to each other.

8. The tube bundle heat exchanger according to claim 1, wherein the nozzles on the rear end of the pressure shell, or the nozzles on the front end of the pressure shell in relation to a plane that is arranged so as to be perpendicular to a longitudinal axis of the tube bundle heat exchanger rest on said plane at any desired angle to each other.

9. The tube bundle heat exchanger according to claim 1, further comprising a heat exposure limiting configuration in which the second three-way valve is maintained in a predetermined flow configuration and the first three-way valve is regulated to control flow of the coolant medium.

10. A tube bundle heat exchanger for cooling a first medium flow with a cooling medium flow, the heat exchanger comprising:

a plurality of heating surface tubes adapted to receive and channel the first medium flow, each of the heating surface tubes having oppositely disposed end portions held in a tubesheet;

a pressure shell enclosing the heating surface tubes, the pressure shell defining a shell side adapted to receive and channel the cooling medium flow;

at least one tube inlet chamber adapted to direct the first medium flow into the heating surface tubes, and at least one tube outlet chamber adapted to collect the first medium flow from the heating surface tubes;

first and second nozzles disposed at a rear end of the pressure shell adjoining the tube outlet chamber;

third and fourth nozzles disposed at a front end of the pressure shell adjoining the tube inlet chamber;

a first three-way valve defining a first port, a second port and a third port, a feed pipe connected to the first port and configured to supply the cooling medium flow to the first port, a first bypass pipe extending between the third nozzle and the second port, and a second bypass pipe extending between the first nozzle and the third port;

a second three-way valve defining a fourth port, a fifth port and a sixth port, a drain pipe connected to the sixth port and configured to discharge the cooling medium flow from the sixth port, a third bypass pipe extending between the fourth nozzle and the fourth port, and a fourth bypass pipe extending between the second nozzle and the fifth port;

the first three-way valve and the second three-way valve being controllable to selectively change the heat exchanger from counter-current flow to co-current flow and from co-current flow to counter-current flow, and the first three-way valve being controllable to selectively regulate flow of the cooling medium 8 through the first bypass pipe and the second bypass pipe, and the second three-way valve being controllable to selectively regulate flow of the cooling medium through the third bypass pipe and the fourth bypass pipe; and wherein the second three-way valve is configured to control a temperature of the cooling medium discharged through the sixth port.

11. The tube bundle heat exchanger according to claim 10, wherein at least one of the first or second three-way valves is a switch valve.

12. The tube bundle heat exchanger according to claim 11, wherein in relation to the cooling medium flow the switch valve is disposed at a feed side of the tube bundle heat exchanger.

13. The tube bundle heat exchanger according to claim 10, comprising:

a flow rate measurement device disposed within one or more of the first, second, third, or fourth bypass pipes.

14. The tube bundle heat exchanger according to claim 10, wherein the nozzles at the rear end of the pressure shell, and the nozzles at the front end of the pressure shell are situated identically when viewed in the direction of a longitudinal axis of the tube bundle heat exchanger.

15. The tube bundle heat exchanger according to claim 10, wherein the nozzles at the rear end of the pressure shell, or the nozzles at the front end of the pressure shell are situated identically when viewed in the direction of a longitudinal axis of the tube bundle heat exchanger.

16. The tube bundle heat exchanger according to claim 10, wherein the nozzles on the rear end of the pressure shell, and the nozzles on the front end of the pressure shell in relation to a plane that is arranged so as to be perpendicular to a longitudinal axis of the tube bundle heat exchanger rest on said plane at any desired angle to each other.

17. The tube bundle heat exchanger according to claim 10, wherein the nozzles on the rear end of the pressure shell, or the nozzles on the front end of the pressure shell in relation to a plane that is arranged so as to be perpendicular to a longitudinal axis of the tube bundle heat exchanger rest on said plane at any desired angle to each other.

18. The tube bundle heat exchanger according to claim 10, wherein the third nozzle is configured to lead in the cooling medium flow, and the second and fourth nozzles are configured to lead away the cooling medium flow, the cooling medium flow in the shell side being in co-current flow with the first medium flow.

19. The tube bundle heat exchanger according to claim 10, wherein the first nozzle is configured to lead in the cooling medium flow, and the second and fourth nozzles are configured to lead away the cooling medium flow, the cooling medium flow in the shell side being in counter current flow with the first medium flow.

20. The tube bundle heat exchanger according to claim 10, further comprising a heat exposure limiting configuration in which the second three-way valve is maintained in a predetermined flow configuration and the first three-way valve is regulated to control flow of the coolant medium.

* * * * *